US008970443B2

(12) United States Patent
Ridgeway

(10) Patent No.: US 8,970,443 B2
(45) Date of Patent: Mar. 3, 2015

(54) COMPACT BALANCED EMBEDDED ANTENNA

(71) Applicant: Digi International Inc., Minnetonka, MN (US)

(72) Inventor: Robert Wayne Ridgeway, Saratoga Springs, UT (US)

(73) Assignee: Digi International Inc., Minnetonka, MN (US)

( * ) Notice: Subject to any disclaimer, the term of this patent is extended or adjusted under 35 U.S.C. 154(b) by 204 days.

(21) Appl. No.: 13/756,763

(22) Filed: Feb. 1, 2013

(65) Prior Publication Data

US 2014/0218252 A1 Aug. 7, 2014

(51) Int. Cl.

| | |
|---|---|
| ***H01Q 9/16*** | (2006.01) |
| ***H01P 11/00*** | (2006.01) |
| ***H01Q 1/24*** | (2006.01) |
| ***H01Q 1/38*** | (2006.01) |
| ***H01Q 9/26*** | (2006.01) |

(52) U.S. Cl.

CPC ..... *H01P 11/00* (2013.01); *H01Q 1/243* (2013.01); *H01Q 1/38* (2013.01); *H01Q 9/265* (2013.01)

USPC ..... 343/793

(58) Field of Classification Search

USPC ..... 343/793, 795, 807, 700 MS

See application file for complete search history.

(56) References Cited

U.S. PATENT DOCUMENTS

| | | | | |
|---|---|---|---|---|
| 4,825,220 | A | 4/1989 | Edward et al. | |
| 8,232,923 | B2 * | 7/2012 | Yang | 343/700 MS |
| 8,350,774 | B2 * | 1/2013 | Pickles | 343/795 |
| 8,659,483 | B2 * | 2/2014 | Ridgeway | 343/700 MS |
| 2009/0096698 | A1 * | 4/2009 | Semonov et al. | 343/795 |

* cited by examiner

*Primary Examiner* — Dameon E Levi

*Assistant Examiner* — Hasan Islam

(74) *Attorney, Agent, or Firm* — Fogg & Powers LLC

(57) ABSTRACT

A planar antenna, such as included as a portion of printed circuit board assembly, can include a balanced configuration comprising a first conductive layer. The first conductive layer can include a first arm having a footprint extending in a first direction and a second arm having a footprint extending in a direction opposite the first direction. The second arm can be sized and shaped to be similar to the footprint of the first arm.

20 Claims, 5 Drawing Sheets

COMPACT BALANCED EMBEDDED ANTENNA

BACKGROUND

Information can be wirelessly transferred using electromagnetic waves. Generally, such electromagnetic waves are either transmitted or received using a specified range of frequencies, such as established by a spectrum allocation authority for a particular location where a wireless device or assembly will be used or manufactured. Wireless devices or assemblies generally include one or more antennas, and each antenna can be configured for transfer of information at a particular range of frequencies. Such ranges of frequencies can include frequencies used by wireless digital data networking technologies. Digital data networking technologies can use, conform to, or otherwise incorporate aspects of one or more protocols or standards, such as for providing cellular telephone or data services, fixed or mobile terrestrial radio communications, satellite communications, or for other applications.

OVERVIEW

A wireless device can be configured to transfer information using different operating frequency ranges (e.g., bands). In generally-available devices, such information transfer can be performed using separate antennas designed to operate in respective frequency ranges. Such antennas can be assemblies separate from other communication circuitry, such as coupled to the communication circuitry using one or more cables or connectors. Manufacturing cost, complexity, or reliability can be negatively affected by use of such separate antennas. The present inventor has recognized, among other things, that a printed circuit board wide-band antenna can reduce or eliminate a need for separate antennas to provide coverage of different operating frequency ranges.

Also, antenna configurations can include balanced or unbalanced configurations. For example, a balanced antenna configuration can provide enhanced gain, substantially-omnidirectional response in at least one plane, and reduced radiation pattern sensitivity and reduced input impedance fluctuation in response to changing surroundings, as compared to single-ended antenna configurations, but at a cost of larger dimensions or additional interface circuitry as compared to various unbalanced antenna configurations.

For example, generally-available communication circuits generally provide an electrically unbalanced communication port for coupling communication signals between an antenna and the communication circuit. In applications where a balanced antenna is desired, a balun can be used to couple and match the balanced antenna to an unbalanced source. A discrete balun, such as included as a portion of a communication circuit, can increase cost and consume substantial volume. Such costs and complexity can increase further in multi-band applications where multiple antennas or baluns may be needed.

The present inventor has recognized, among other things, that a balanced antenna configuration can be formed as a portion of a printed circuit board (PCB) assembly (e.g., the planar antenna can be "embedded" in the PCB design rather than including a separate antenna assembly). The present inventor has also recognized that such a balanced antenna configuration can include a distributed balun as a portion of one or more conductive layers included in the PCB assembly.

A planar antenna, such as included as a portion of printed circuit board assembly, can include a balanced configuration comprising a first conductive layer. The first conductive layer can include a first arm having a footprint extending in a first direction and a second arm having a footprint extending in a direction opposite the first direction. The second arm can be sized and shaped to be similar to the footprint of the first arm.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1A:
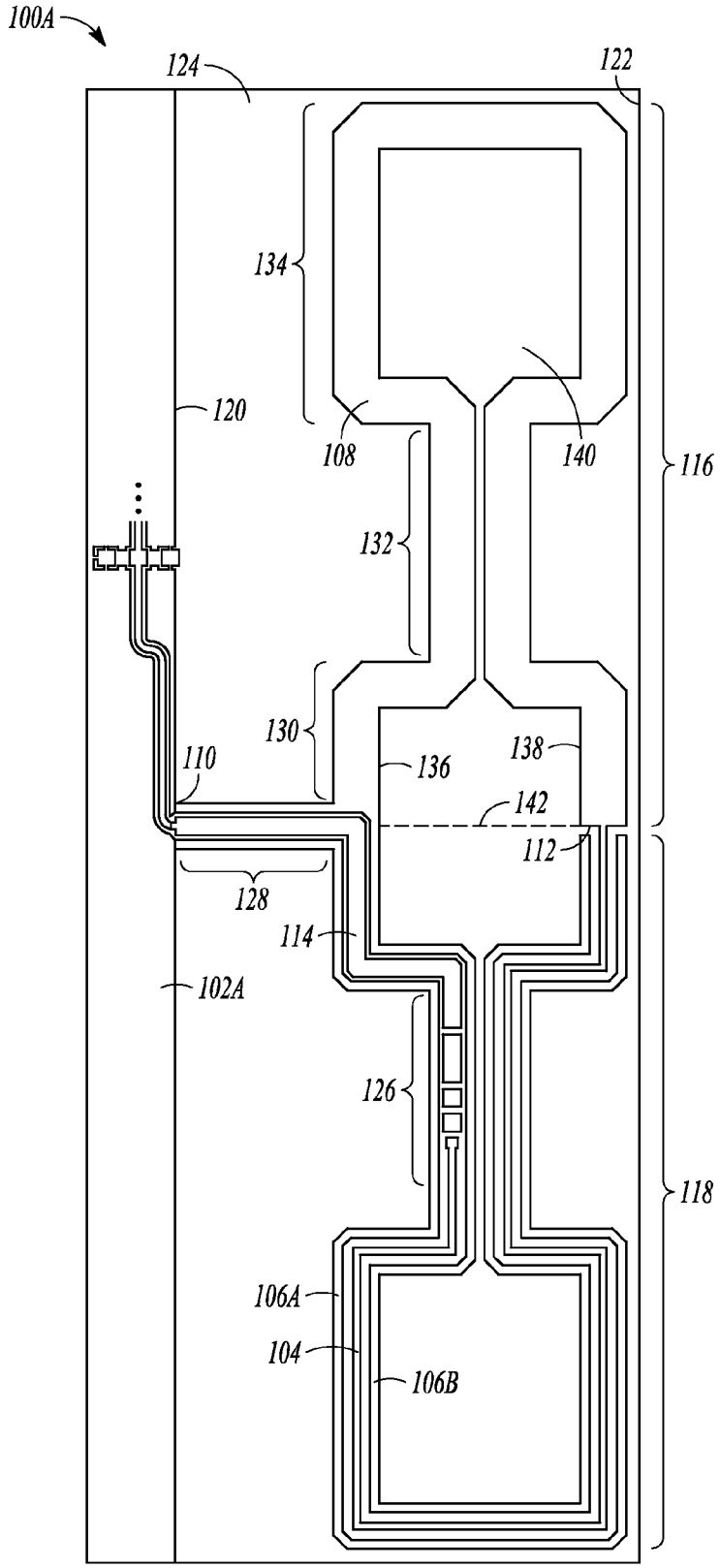
FIG. 1A illustrates generally an example of at least a portion of a planar antenna, such as can include first conductive layer.
Figure 1B:
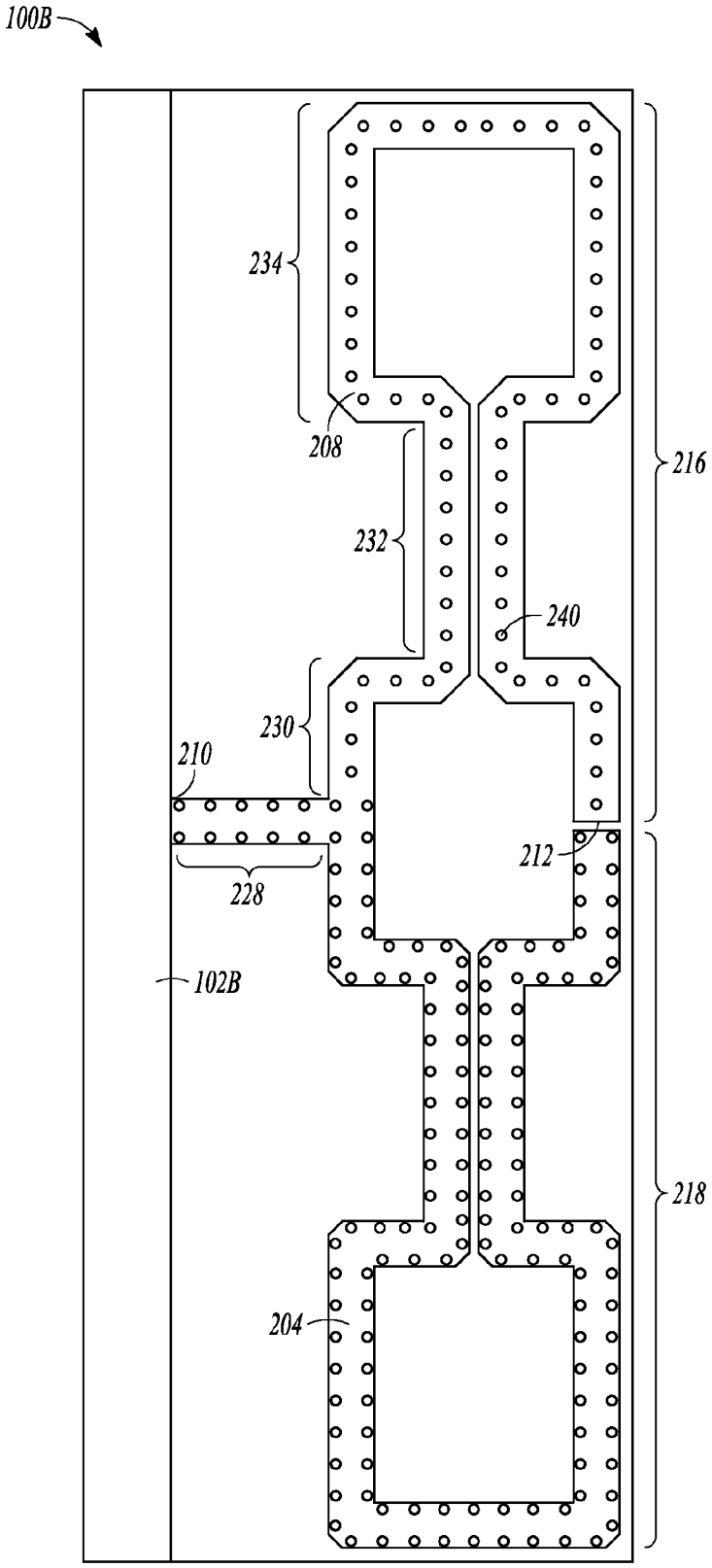
FIG. 1B illustrates generally an example of at least a portion of a planar antenna, such as can include a second conductive layer.

FIG. 1A illustrates generally an example of at least a portion of a planar antenna, such as can include first conductive layer 100A comprising one or more conductive strips. The planar antenna can include one or more conductive layers, such as shown in the example of FIGS. 1A and 1B. For example, the planar antenna can include a first conductive layer 100A aligned with corresponding conductive strips on a second conductive layer 100B, such as shown in the example of FIG. 1B, or aligned with one or more other conductive layers.

The first conductive layer 100A can include a reference conductor 102A, such as ground plane or other structure that can be laterally offset from other portions of the planar antenna. The region of reference conductor 102A can include other circuitry, such as a wireless communication circuit configured to transmit or receive information electromagnetically using the planar antenna. The first conductive layer 100A can be formed, patterned, or otherwise fabricated such as coupled to a dielectric material 124 (e.g., one or more of the first conductive layer 100A or the second conductive layer 100B can include metallization layers on a printed circuit board assembly).

The planar antenna can include a first arm 116, such as having a footprint (e.g., pattern or plan view such as shown in FIG. 1A) extending in a first direction. For example, the first direction can be an axial direction extending away from a central line of symmetry 142. The first arm 116 can include a first conductive strip 108, such as having a first lateral width. The planar antenna can include a second arm 118 having a footprint sized and shaped to be similar to the footprint of the first arm 116. The second arm 118 need not be identical to the first arm 116. For example, the second arm 118 can include a second conductive strip 104 that can be narrower in lateral width than the first conductive strip 108 of the first arm, such as shown in FIG. 1A. The phrase "footprint" can refer to an extent of outer or inner boundaries of conductive portions of one of the first or second arms 116 or 118, or can refer to a path traced out by an antenna conductor, for example.

The second arm 118 can be coupled (e.g., conductively coupled) to the first arm 116 at a distal location 112, such as a location distal with respect to a feed location 110. The second arm 118 can include one or more conductive strips coplanar with the second conductive strip 104, such as located laterally nearby the second conductive strip 104. For example, the one or more conductive strips can include an outside-facing conductive strip 106A or an inside-facing conductive strip 106B. The outside-facing or inside-facing conductive strips 106A or 106B can be terminated as stubs at or nearby the distal location 112. In this manner, the outside-facing or inside-facing conductive strips 106A or 106B can provide at least a portion of a balun structure, such as configured to transition from a single-ended antenna port at the feed location 110, to a balanced configuration for operation of the planar antenna.

The planar antenna of the example of FIGS. 1A and 1B need not provide uniform separation between portions of the respective conductive strips closer to the feed location 110, such as an inboard portion 136 of the first conductive strip 108, and an outboard portion 138 of the first conductive strip 108. For example, the planar antenna can include one or more pinched regions, such as a first pinched region 132 about halfway along a long axis of the first arm 116. The present inventor has recognized, among other things, that in this manner, the non-pinched regions, such as a first non-pinched region 130, or a second non-pinched region 134, can be used to tune the antenna for wideband operation in a specified range of frequencies while consuming less total area than a corresponding folded-dipole configuration.

A width of one or more conductive strips need not be uniform in the planar antenna. For example, the planar antenna may include a second conductive strip 104 that can vary along the footprint of the second arm 118, such as including a wider portion 114 in a first region, and a narrower portion elsewhere. One or more discrete or distributed matching components can be used to establish a specified input impedance for the planar antenna, such as including one or more conductive pads in the region 126. For example, one or more "L" or "it" matching networks can be used, such as including one or more series inductors and one or more shunt capacitors.

A feed location 110 of the planar antenna can be coupled to a coplanar waveguide or transmission line structure in the region 128 near the feed location 110. For example, the wider portion 114 of a conductive strip included in the second arm 118 can sized to establish a specified impedance, such as a real impedance of about 50 ohms, and can transition to the narrow portion at a location in the region 126. The location of the transition can be specified at least in part to establish a specified impedance-matched bandwidth of the planar antenna, such as to provide the voltage standing wave ratio (VSWR) as shown in the illustrative example of FIG. 3. An input impedance of the planar antenna can be controlled, such as to present a specified input impedance (e.g., a specified real impedance or a specified conjugate match to an output impedance of the communication circuit).

FIG. 1B illustrates generally an example of at least a portion of a planar antenna, such as located vertically offset (e.g., above or below) from a plane of the first conductive layer 100A of the example of FIG. 1A. The example of FIG. 1B can include a second conductive layer 100B, such as having a similar footprint to the conductive layer 100A. For example, as shown in FIG. 1B, the second conductive layer 100B can include a first arm 216, such as located vertically offset from the first arm 116 of the first conductive layer 100A. The second conductive layer 100B can include a second arm 218 having a footprint similar to the first arm 216 of the second conductive layer 218 (e.g., such as including an outline representing a mirror image of the first arm 216). The two arms 216 and 218 need not be identical. For example, one or more vias such as a via 240 may be used to connect portions of one or more of the conductive layers 100A or 100B together in specified locations.

The first arm 216 of the second conductive layer 100B can include a first conductive strip 208, such as having a similar footprint to the first conductive strip 108 of the first conductive layer 100A. Similarly, the second arm 218 of the second conductive layer 100B can include a second conductive strip 204, such as having an outline similar to the outline defined by one or more portions of the second arm 118 of the first conductive layer 100A.

Similar to the first conductive layer 100A, the second conductive layer 100B can include a first unpinched region 230, such as coupled to a feed location 210 using a conductive strip in the region 228 between the unpinched region 230 and the feed location 210. The second conductive layer 100B can include a pinched region 232, and a second unpinched region 234, to provide a footprint similar to the footprint of the first arm 116 of the first conductive layer.

Figure 2:
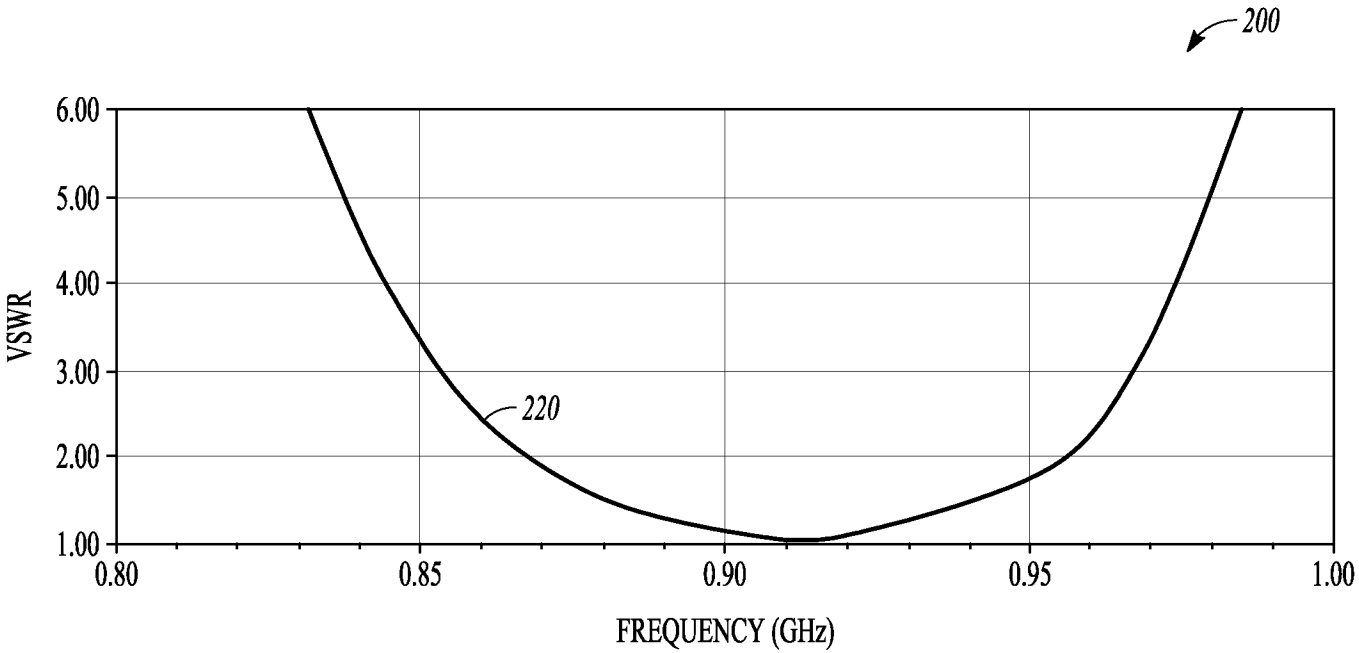
FIG. 2 illustrates generally an illustrative example of a voltage standing wave ratio (VSWR), such as can be simulated for the antenna configuration of FIGS. 1A through 1B.

The second conductive layer 100B of FIG. 2 can include a reference conductor 102B (e.g., a reference plane). The first and second arms 216 and 218 can be coupled to the reference conductor 102B such as using a conductive strip in the region 228. The conductive strip in the region 228 can include or can be a portion of a transmission line structure feeding the planar antenna, such as to establish a specified input impedance, at least in part. The second conductive layer 100B can include a gap 212, such as to establish a portion of a balun structure using the second arm 218 and the corresponding portion of the first conductive layer 100A, such as the second 118 of the first conductive layer 100A. For example, the conductive layers of FIGS. 1A and 1B can be at least approximately symmetric about an axis of symmetry 142 as shown in FIG. 1A. A first current distribution can be established such as in the first conductive strip 108 of the first arm 116 in the first conductive layer 100A. A complementary current distribution can be established in the second conductive strip 104 of the second arm 118 in the first conductive layer 100A. Similarly, respective image currents can be established in the first and second arms 216 and 218 of the second conductive layer 100B.

The planar antenna need not rely on image currents induced or established in the reference conductor 102A or 102B plane regions. In this manner, some degree of self-shielding is provided by the planar antenna, such as providing a more omni-directional and consistent radiation pattern in the presence of discontinuities in the plane geometry (e.g., due to traces, vias, or other circuitry in the region 120 laterally offset from the planar antenna). Such an antenna configuration can also be more immune to geometric variation in conductor geometry due to manufacturing process variations. Simulation of the illustrative example of FIGS. 1A and 1B indicates a radiation efficiency generally better than 50%.

The dielectric material 124 region of the example of FIG. 1A can include a dielectric substrate of a printed circuit board assembly (PCBA). Such a dielectric substrate can include a glass-epoxy laminate such as FR-4, FR-406, or one or more other materials, such as generally used for printed circuit board (PCB) fabrication. Such materials can include a bismaleimide-triazine (BT) material, a cyanate ester, a polyimide material, or a polytetrafluoroethylene material, or one or more other materials. One or more of the conductive portions of FIG. 1A or 1B can include electrodeposited or rolled-annealed copper, such as patterned using a photolithographic process, or formed using one or more other techniques (e.g., a deposition, a stamping, etc.)

FIG. 2 illustrates generally an illustrative example 200 of a voltage standing wave ratio (VSWR) 220, such as can be simulated for the antenna configuration of FIGS. 1A through 1B. A usable range of operating frequencies can be specified in terms of VSWR, or in terms of a corresponding return loss, or using one or more other criteria. For example, a specified $S_{11}$ parameter of about −10 dB or lower (e.g., a return loss of 10 dB), can be considered generally acceptable for a variety of applications. Such a return loss corresponds to a VSWR of about 2:1 or less. In the illustrative example of FIG. 2, the VSWR 220 is less than 2:1 in a range from less than 0.87 gigahertz (GHz) to more than 0.95 GHz, indicating a usable bandwidth of over 0.8 GHz (80 megahertz (MHz)) according to a 2:1 VSWR criterion. Other criteria can be used to establish, determine, or estimate a usable bandwidth (e.g., a 3:1 VSWR criterion).

Figure 3:
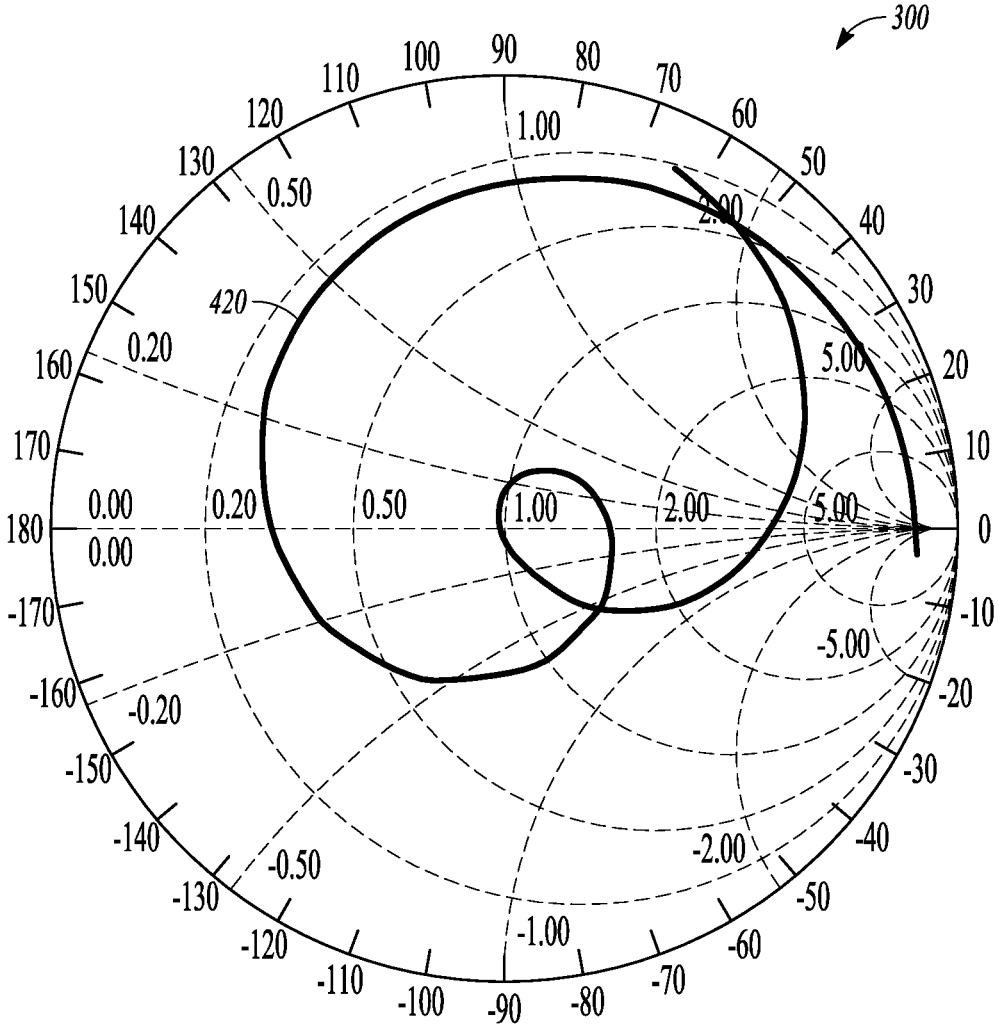
FIG. 3 illustrates generally an illustrative example of an impedance Smith Chart that can be simulated for the antenna configuration of FIGS. 1A and 1B.

FIG. 3 illustrates generally an illustrative example of an impedance Smith Chart 300 that can be simulated for the antenna configuration of FIGS. 1A and 1B. Loops in the impedance response indicate coupling behavior from the multiple elements. One or more geometric or material parameters of the planar antenna can be varied, such as to shift the locus of loops in the impedance closer to the center or unit impedance (e.g., corresponding to 50 ohms real impedance), or to some other desired input impedance to provide a conjugate impedance match to an output of a wireless communication circuit.

Figure 4:
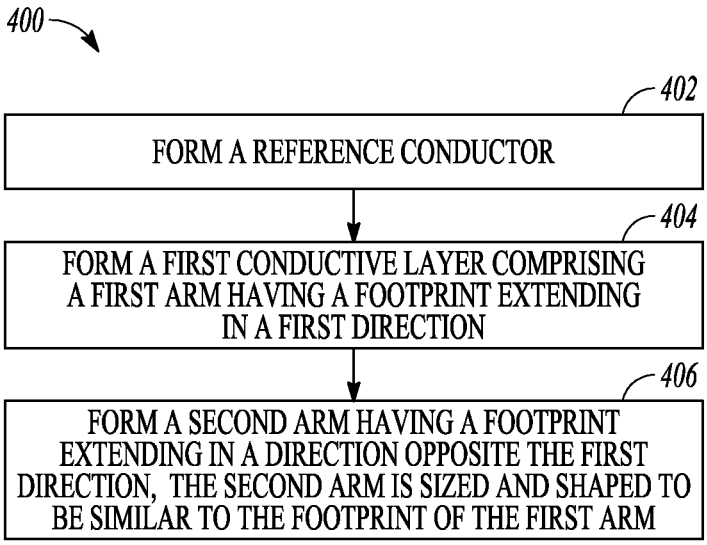
FIG. 4 illustrates generally an illustrative example of a technique, such as a method that can include forming first and second arms of a conductive layer of planar antenna.

FIG. 4 illustrates generally an illustrative example of a technique 400, such as a method, which can include forming first and second arms of a conductive layer of planar antenna, such as a planar antenna as discussed in the examples above. For example, at 402, a reference conductor can be formed (e.g., such as using a lithographic technique or other technique, such as reference conductor 102A or 102B as shown in the example of FIG. 1A or 1B.) At 404, the technique 400 can include forming a first conductive layer comprising a first arm having a footprint extending in a first direction, such as shown in the example of FIG. 1A or 1B.

At 406, a second arm can be formed, such as having a footprint extending in a direction opposite the first direction. The second arm can be sized and shaped to be about the same as a footprint defined by the first arm (e.g., a mirror image of the footprint of the first arm). Other techniques, such as fabrication techniques discussed in the examples of FIG. 1A or 1B, can be included as a portion of the technique 400.

VARIOUS NOTES

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventor also contemplates examples in which only those elements shown or described are provided. Moreover, the present inventor also contemplates examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A planar antenna, comprising:

a first conductive layer comprising:

a reference conductor;

a first arm having a footprint extending in a first direction, the first arm comprising a first conductive strip having a first lateral width and conductively coupled to the reference conductor; and a second arm having a footprint extending in a direction opposite the first direction, the second arm comprising:

a second conductive strip having a second lateral width narrower than the first lateral width, the second conductive strip conductively coupled to the first conductive strip of the first arm at a distal location with respect to a feed location; and one or more conductive strips coplanar with the second conductive strip and conductively coupled to the reference conductor, the one or more coplanar conductive strips located laterally nearby the second conductive strip and respectively extending from the feed location along the second conductive strip and respectively terminating as stubs at the distal location;

wherein the second arm is sized and shaped to be similar to the footprint of the first arm.

2. The planar antenna of claim 1, wherein the first and second arms include respective pinched regions wherein a lateral separation between interior edges of the respective first and second arms is reduced as compared to other portions of the first and second arms.

3. The planar antenna of claim 2, wherein the first and second arms include the respective pinched regions at a location about halfway along respective long axes of the first and second arms.

4. The planar antenna of claim 1, wherein the one or more coplanar conductive strips respectively define exterior and interior boundaries of a footprint of the second arm; and wherein a distance between an exterior lateral edge of an exterior coplanar conductive strip and an interior lateral edge of an interior coplanar conductive strip is about the same as the first lateral width.

5. The planar antenna of claim 1, wherein the second lateral width of the second conductive strip varies along the length of the second conductive strip.

6. The planar antenna of claim 5, wherein the second lateral width of the second conductive strip is configured to provide a specified input impedance for the planar antenna in a specified range of operating frequencies.

7. The planar antenna of claim 1, wherein one or more matching components are located along the second conductive strip in the second arm.

8. The planar antenna of claim 1, wherein the reference conductor comprises a reference plane.

9. The planar antenna of claim 1, comprising a second conductive layer vertically offset from the first conductive layer, the second conductive layer including one or more conductive strips having a lateral width about the same as the first lateral width and including respective footprints similar to the first and second arms, respectively, the one or more conductive strips separated by a gap at a location corresponding to the distal location.

10. The planar antenna of claim 9, comprising a dielectric substrate;

wherein the first conductive layer is located on a first surface of the dielectric substrate; and wherein the second conductive layer is located on a second surface of the dielectric substrate.

11. The planar antenna of claim 10, wherein the first conductive strip and the one or more coplanar strips are conductively coupled to corresponding portions of the one or more conductive strips of the second conductive layer using respective via structures.

12. The planar antenna of claim 9, wherein the feed location comprises an unbalanced port of a wireless communication circuit; and wherein the second arm establishes a planar balun configured to couple unbalanced signals between the unbalanced port and a balanced radiating structure comprising the first and second arms.

13. The planar antenna of claim 12, wherein the feed location comprises a coplanar waveguide structure;

wherein the one or more coplanar conductive strips are respectively conductively coupled to one or more outer conductors included as a portion of the coplanar waveguide structure; and wherein the second conductive strip is conductively coupled to a center conductor included as a portion of the coplanar waveguide structure.

14. A system, comprising:

a wireless communication circuit a planar antenna, comprising:

a first conductive layer comprising:

a reference conductor;

a first arm having a footprint extending in a first direction, the first arm comprising a first conductive strip having a first lateral width and conductively coupled to the reference conductor; and a second arm having a footprint extending in a direction opposite the first direction, the second arm comprising:

a second conductive strip having a second lateral width narrower than the first lateral width, the second conductive strip conductively coupled to the first conductive strip of the first arm at a distal location with respect to a feed location; and one or more conductive strips coplanar with the second conductive strip and conductively coupled to the reference conductor, the one or more coplanar conductive strips located laterally nearby the second conductive strip and respectively extending from the feed location along the second conductive strip and respectively terminating as stubs at the distal location;

a second conductive layer vertically offset from the first conductive layer, the second conductive layer including one or more conductive strips having a lateral width about the same as the first lateral width and including respective footprints similar to the first and second arms, respectively, the one or more conductive strips separated by a gap at a location corresponding to the distal location;

wherein the second arm is sized and shaped to be similar to the footprint of the first arm;

wherein the first and second arms include respective pinched regions wherein a lateral separation between interior edges of the respective first and second arms is reduced as compared to other portions of the first and second arms.

15. The system of claim 14, wherein the wireless communication circuit is configured to wirelessly transfer information using the planar antenna operating in a range of frequencies selected from a range of about 870 MHz to about 950 MHz.

16. A method for forming a planar antenna, comprising:

forming a reference conductor;

forming a first conductive layer comprising a first arm having a footprint extending in a first direction, the first arm comprising a first conductive strip having a first lateral width and conductively coupled to the reference conductor; and forming a second arm having a footprint extending in a direction opposite the first direction, the second arm comprising:

a second conductive strip having a second lateral width narrower than the first lateral width, the second conductive strip conductively coupled to the first conductive strip of the first arm at a distal location with respect to a feed location; and one or more conductive strips coplanar with the second conductive strip and conductively coupled to the reference conductor, the one or more coplanar conductive strips located laterally nearby the second conductive strip and respectively extending from the feed location along the second conductive strip and respectively terminating as stubs at the distal location;

wherein the second arm is sized and shaped to be similar to the footprint of the first arm.

17. The method of claim 16, wherein forming the first and second arms includes forming respective pinched regions wherein a lateral separation between interior edges of the respective first and second arms is reduced as compared to other portions of the first and second arms.

18. The method of claim 16, comprising forming a second conductive layer vertically offset from the first conductive layer, the second conductive layer including one or more conductive strips having a lateral width about the same as the first lateral width and including respective footprints similar to the first and second arms, respectively, the one or more conductive strips separated by a gap at a location corresponding to the distal location.

19. The method of claim 18, comprising establishing a feed location at an unbalanced port of a wireless communication circuit; and establishing a planar balun configured to couple unbalanced signals between the unbalanced port and a balanced radiating structure comprising the first and second arms.

20. The method of claim 18, wherein forming the first conductive layer includes locating the first conductive layer on a first surface of a dielectric substrate;

wherein forming the second conductive layer includes locating the second conductive layer on a second surface of the dielectric substrate; and wherein the method includes conductively coupling the first conductive strip and the one or more conductive strips are to corresponding portions of the one or more conductive strips of the second conductive layer using respective via structures.

* * * * *